United States Patent [19]

Kozlowski et al.

[11] Patent Number: 4,714,181

[45] Date of Patent: Dec. 22, 1987

[54] CONDIMENT BOTTLE CAP

[75] Inventors: Thomas A. Kozlowski, Brunswick; Robert O. Lindstrom, Bay Village; Thomas D. Loughrin, Medina; Kathleen J. Baka, Lakewood, all of Ohio

[73] Assignee: Durkee Industrial Foods Corp., Cleveland, Ohio

[21] Appl. No.: 898,618

[22] Filed: Aug. 21, 1986

[51] Int. Cl.[4] ..... B67D 3/00

[52] U.S. Cl. ..... 222/480; 222/482; 222/556; 215/237

[58] Field of Search ..... 222/153, 189, 196.1, 222/478, 480, 481, 482, 484–486, 498–499, 519–520, 545–546, 550, 556, 565; 215/232, 235, 237, 349

[56] References Cited

U.S. PATENT DOCUMENTS

| | | | |
|---|---|---|---|
| 2,043,226 | 6/1936 | Beider et al. | 215/232 X |
| 3,018,931 | 1/1962 | Westgate | 222/480 |
| 3,140,019 | 7/1964 | Barr | 222/480 |
| 3,563,426 | 2/1971 | Bartilson | 222/556 |
| 3,659,756 | 5/1972 | Lancaster | 222/556 X |
| 4,059,201 | 11/1977 | Foster | 222/541 X |
| 4,369,901 | 1/1983 | Hidding | 222/480 |
| 4,494,679 | 1/1985 | Cleevely | 222/480 X |

*Primary Examiner*—Joseph J. Rolla
*Assistant Examiner*—Michael S. Huppert

[57] ABSTRACT

A molded plastic cap suitable for large condiment bottles. The cap is of the type which are threaded onto the mouth of the bottle and contains an inner sealing liner. The sealing liner is compressed by the cap against the bottle mouth upon application thereto. The sealing liner cap includes a reinforcing bridge portion and flat circular land portion for press sealing the liner against the bottle rim mouth. The bridge portion includes ribs which are substantially flush with the land portion on the inside surface. The configuration of the cap assembly provides a structure which is attractive in appearance and is free of dimensional distortions.

8 Claims, 8 Drawing Figures

CONDIMENT BOTTLE CAP

The present invention relates to a plastic cap for bottles, and more particularly to a cap especially adapted for use on large condiment bottles, e.g., one-pound spice bottles.

Such bottles of this size are normally used by restaurants and others in the food processing field, as contrasted with the small spice bottles used conventionally by homemakers.

BACKGROUND OF THE PRESENT INVENTION

Large plastic bottles suitable for containing spices and other such condiments are commonly used in the food processing industry, for instance by restaurants. The bottles are preferably somewhat clear, so that the user can determine how much is in the bottle, and also, desirably, visually ascertain the nature of the contents of the bottle.

A number of requirements exist with regard to the design of the bottle, some of which requirements also pertain to the cap for the bottle. The bottle, and also the cap, have to be attractive in appearance. They also have to be functional; for instance, easy to use. With regard to the cap, this means that the user has to have easy access to the bottle contents. Further, the bottles have to be easy to store and compatible with other condiment containers. Still further, they have to have good sealing characteristics for reasonably long shelf life of the bottle contents.

The cap especially must be inexpensive to manufacture and apply to the bottle, and for this reason preferably is molded as a single piece. For single piece plastic caps, it is well known that the design of the cap, particularly dimensions, is critical. Large masses of plastic, or large areas of different thickness than other areas. tend to set up dimensional stresses during cooling, which will cause distortion in the cap, in turn resulting in a poor fit with the bottle mouth, and poor sealing.

One-piece, molded plastic caps, broadly of the type of the present invention, are known. An example of such a cap is disclosed in issued U.S. Pat. No. 3,140,019. In this patent, there is disclosed a top having an upper, circular surface and an annular rim depending from the edge of such surface suitably grooved to engage a container mouth. The top has across its upper surface a central strip portion which sections the upper surface approximately in half. Aperture means are provided on opposite sides of the central strip for such functions as spooning or sifting contents from the container. A pair of lids are hinged to opposite sides of the central strip adapted to close the aperture means. The top is not adapted to be used with an inner sealaing liner.

It is also known to provide such container and top assemblies with a sealing liner across the mouth of the container adapted to seal close the container and keep the contents thereof fresh until use. Application of the liner takes place during the container filling and closing operation. This is a multi-step operation in which the container is first filled. The liner is then applied to the container mouth and heat sealed to the mouth rim. Finally, the top is press fitted or screw applied over the mouth.

One or more disadvantages may exist with regard to such prior art container and top assemblies. One is the cost of the multiple-step filling and closing operation, which can be reduced with elimination of one or more steps. Another disadvantage is that the top lids do not always lock securely in place, closing the above-mentioned apertures. Also, the lids, because of the way the top may be designed, may not be flush with the overall upper surface of the cap, creating a less than optimum appearance. Still further, the top may not be of uniform thickness throughout, so that on cooling, following molding, dimensional stresses can be set up, causing distortion in the top and poor fitting with the container mouth.

Accordingly, it is an object of the present invention to provide a cap assembly by which the above disadvantages are overcome, particularly one by which the cost of filling and closing is reduced.

More specifically, it is an object of the present invention to provide a cap assembly of the type in question, which has a liner sealed to the container mouth, by which the step of heat sealing the liner to the container prior to application of the cap can be avoided.

It is also an object of the present invention to provide a cap assembly which is attractive in appearance and which is free of dimensional distortions.

BRIEF SUMMARY OF THE PRESENT INVENTION

The cap of the present invention is of the type including a cap circular end and annular skirt depending from said end adapted to be threaded onto the mouth of a condiment bottle and to contain an inner sealing liner compressed by the cap end against the bottle mouth rim, said end having an inside surface and an exposed topside surface, a reinforcing bridge portion extending across said end from one side to the other, aperture means on opposite sides of said bridge portion, and lid means adapted to close said aperture means, the improvement wherein said inside surface defines a flat, circular land portion contiguous with the skirt and having a limited width dimension effective to press seal said sealing liner against the bottle mouth rim, said bridge portion including a longitudinally extending reduced thickness center part and longitudinally extending ribs on opposite sides of said center part, said ribs being substantially flush on the inside with said land portion and extending upwardly on the top side from said center part, the lid means being hinged to said longitudinally extending ribs.

Preferably, the aperture means comprises a spoon hole on one side of said bridge means and a sift area on the opposite side.

Also, in a preferred embodiment, the locking means for the spoon hole lid comprises a plurality of spaced-apart tabs on the underside of the lid means defining an interference fit with confronting surfaces of said upper surface on movement of the spoon hole lid to a closed position.

The present invention also resides in a cap assembly comprising the cap as above identified, in combination with a circular, sealing liner, the latter being adapted to be glue sealed to the bottle mouth rim.

It will be apparent to those skilled in the art that one advantage of the present invention is the absence of large masses in the cap body, larger or thicker than in other areas, likely to cause dimensional distortion in the cap on cooling, following molding. Since the cap is free of dimensional distortion, it fits well with the bottle mouth and is capable of holding the glued liner in place until setting of the glue occurs. This, in turn, eliminates the need for heat sealing the liner to the bottle mouth.

BRIEF DESCRIPTION OF THE DRAWINGS

The present invention and advantages thereof will become more apparent upon consideration of the following specification with reference to th accompanying drawings, in which.

DETAILED DESCRIPTION OF THE PRESENT INVENTION

Figure 1:
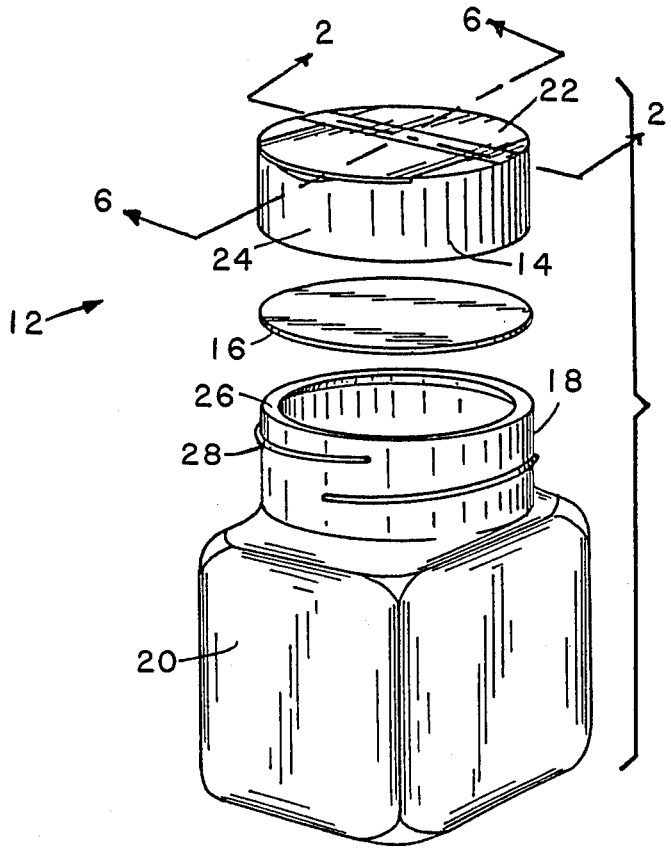
FIG. 1 is a perspective elevation view of a cap of the present invention in exploded relationship with a liner and bottle with which the cap is used.
Figure 2:
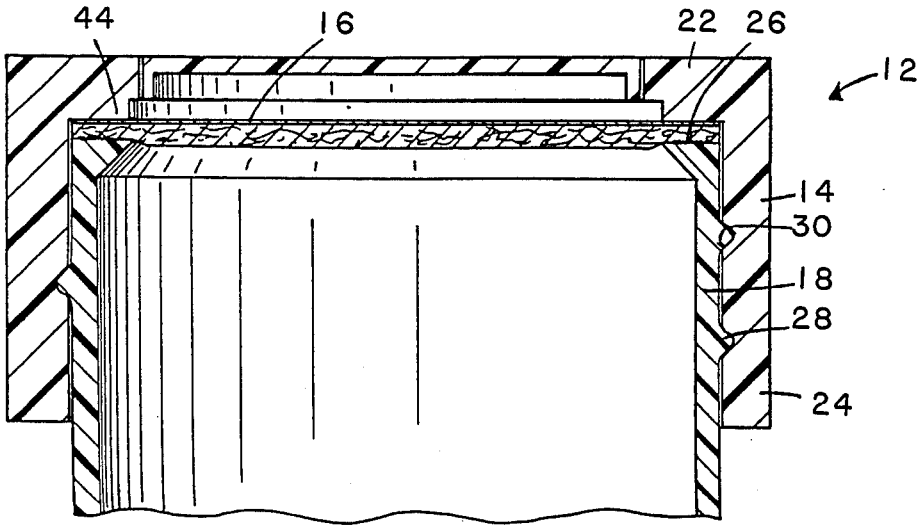
FIG. 2 is a section view taken along line 2—2 of FIG. 1.

Referring to FIGS. 1 and 2, the cap assembly 12 of the present invention comprises a cap 14 and insert liner 16 adapted to be applied to the mouth 18 of bottle 20. The cap is semi-cylindrical in shape, having a circular end portion 22 and an annular skirt 24 depending from the end portion.

The insert 16 is circular and dimensioned to seat within the cap 14 and onto the rim 26 of the bottle mouth 18. The bottle mouth is provided with threads 28, the cap being of the screw-on type with internal threads 30 (FIG. 2) cooperating with the bottle threads.

Figure 3:
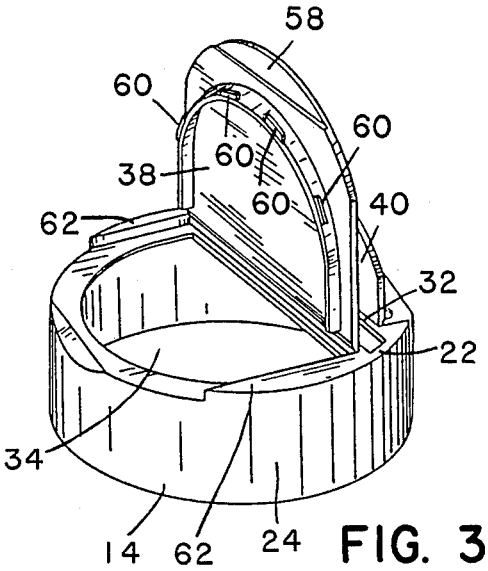
FIG. 3 is a perspective view of the cap of FIG. 1 showing the lids thereof in a raised position.
Figure 4:
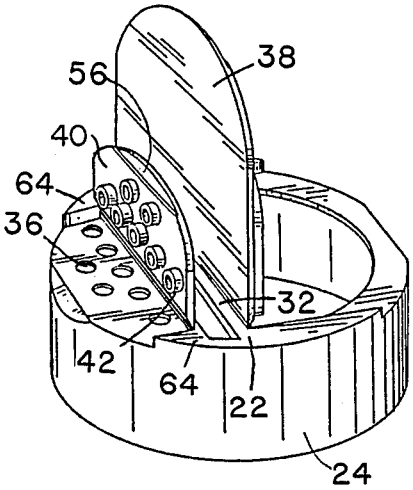
FIG. 4 is a perspective view of the cap of FIG. 1, similar to FIG. 3, but taken from the opposite side of the cap.

As shown in FIGS. 3 and 4, the cap end 22 is comprised of a bridge portion 32 which extends across the top fron one side of the cap to the other. The bridge portion may be centered so that it extends diametrically across the top of the cap or it may be offset somewhat to one side as shown in FIGS. 3 and 4. The bridge portion divides the cap upper surface into aperture means on opposite sides thereof. As best shown in FIG. 3, the aperture means on one side is a large opening 34 for spooning contents from the bottle. As best shown in FIG. 4, the aperture means on the opposite side is a sift hole area 36, more suitable for sifting contents from the bottle. A large lid 38 (FIG. 3) is hinged connected, in a manner to be described, to one side of the bridge portion 32, adapted to close the spooning aperture 34. A smaller lid 40 (FIG. 4) is hinged connected to the opposite side of the bridge portion 32, also in a manner to be described, adapted to close the sift hole area 36. Both of the lids are semi-moon shaped. The sift lid 40, on its underside, is provided with plugs 42 which are aligned with the holes of the sift hole area 36 to close the holes on closure of the lid.

Figure 5:
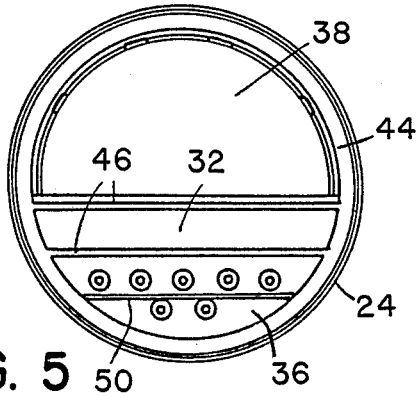
FIG. 5 is a plan view of the underside of the cap of FIG. 1.

Details of the underside of the lid are shown in FIG. 5. Illustrated in FIG. 5 is the underside of the bridge portion 32, with the large spooning lid 38 and smaller sift area 36 on opposite sides of the bridge portion. An annular, flat land area 44 extends entirely around the periphery of the underside of the cap contiguous with the cap skirt 24. The purpose of this flat land area is to press the insert liner 16 firmly against the rim 26 of the bottle when the cap is threaded onto the bottle mouth, as shown in FIG. 2.

In this respect, in the filling and closing operation, the bottle 20 is first filled with a condiment, and glue is applied to the bottle rim 26. The insert liner 16 is seated within the cap 14, and when the cap is threaded onto the bottle mouth, the insert is compressed against the rim 26. It is thus firmly held in place while setting of the glue takes place. The insert is of a composite cardboard aluminum material adapted to seal the bottle form air and moisture, preventing flavor loss of contents within the bottle, protecting the quality of the contents. By glue adhering the liner to the bottle rim, the sealing is complete regardless of the air tightness or sealing integrity of the cap itself.

Figure 6:
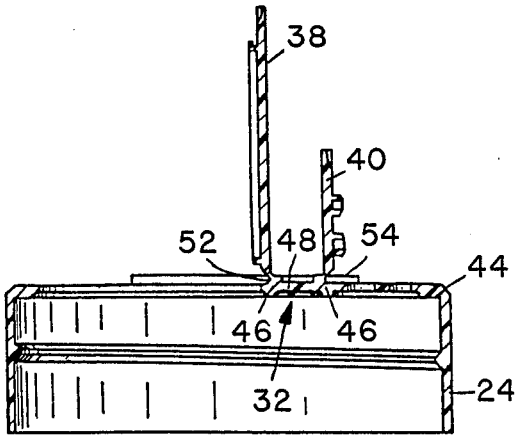
FIG. 6 is a section view similar to FIG. 2 taken along lines 6—6 of FIG. 1, but with the lids in a raised position.

A principal feature of the cap of the present invention is that the major bulk areas of the cap are of equal thickness, so that there is no large mass of plastic greater in one area than in any other area likely to cause distortion of the cap from cooling stresses following cap molding. At the same time, the cap is provided with a reinforcing structure, namely, the land area 44 and bridge portion 32, to maintain rigidity in the cap. Details of the bridge portion are illustrated in FIG. 6, comprising longitudinally extending ribs 46 extending on opposite sides of a lesser thickness center area 48 in a longitudinal direction. As shown, the ribs, on the underside of the cap, are generally flush with the face of the land area 44. This means taht the ribs, of necessity, must extend upwardly above the overall plane of the cap exposed topside surface (e.g. the plane of the sift area 36) to achieve the rigidity or reinforcing necessary while at the same time avoiding the presence of a large mass thicker in dimension than the rest of the cap. In this respect, the thickness of the bridge center area 48 is generally the same as that of other parts of the cap, for instance, the sift hole area 36. By extending the ribs above the overall plane of the cap exposed topside, and the underside of the bridge portion, generally flush with the land area 44, distortion of the insert liner by the bridge portion when the cap is screwed into position is avoided. At the same time, the upstanding ribs provide convenient surfaces on which to hinge the lids 38 and 40, as shown in FIG. 6, and avoiding interference with other portions of the cap when the lids are pivoted to closed positions.

For additional reinforcing, the sift hole area can also be provided with a longitudinally extending reinforcing rib 50, if desired.

It will be apparent to those skilled in the art that the cap of the present invention is uniformly of about the same thickness of plastic througout, except in the reinforcing areas. The reinforcing areas are essentially the ribs in the bridge portion, the rib in the sift hole area, and the circular land area contiguous with the cap skirt. All of these reinforcing areas are formed so that the high areas on the underside of the cap are substantially flush with each other to firmly press against the insert, but at the same time avoid distortion of the insert.

In addition to the above, the reinforcing areas serve additional functions, the circular land area providing a narrow surface to press against the insert. The longitudinally extending ribs of the bridge portion provide raised areas onto which the lids are hinged. Living hinges 52 and 54 connect the lids to the upper edges of the ribs.

Figure 7:
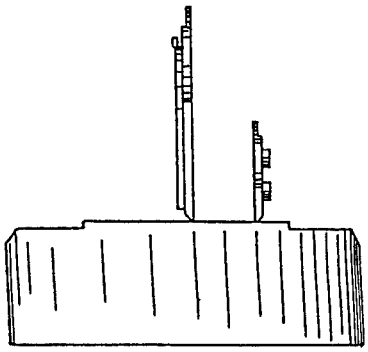
FIG. 7 is a side elevation view of the cap of FIG. 1 showing the lids in a raised position.
Figure 8:
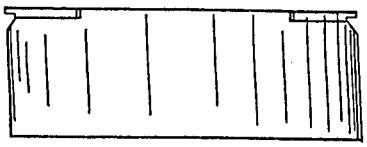
FIG. 8 is a side elevation view of the cap of FIG. 1 showing the lids in a closed position.

Again, one advantage with connecting the lids to the upper outer longitudinally extending edges of the ribs is that clearance is provided for movement of the lids from the upright position shown in FIG. 7 to a closed position shown in FIG. 8, without interference with any portion of the cap upper surface.

Additional features of the cap of the present invention should be apparent from the drawings. As mentioned, the underside of the sift hole lid 40 is provided with a plurality of plugs adapted to seat in and close the sift holes. These plugs are dimensioned so as to provide an interference or friction fit with the sift holes, in turn providing a locking function when the lid is moved to a closed position. At the outer edge of the lid there is provided an undercut or beveled area 56, FIG. 4, which allows a user to move the lid from a closed position to the upright position as shown in FIG. 8.

Similarly, the spoon opening lid is provided with an undercut or beveled area 58, FIG. 3, at its remote edge from the hinge to provide a means for raising the lid. This lid is provided with a plurality of spaced flanges 60 around the underside thereof adapted to engage an edge of the hole opening, with either an interference fit or a friction fit. As shown in FIG. 3, the lid preferably is provided with four spaced-apart flanges of small dimension. This makes the lid easy to raise, using a thumbnail, since the initial resistance to overcome is only in the flange immediately adjacent to the undercut area. At the same time, the use of four such flanges around the periphery of the lid securely holds the lid flush with the cap upper surface when the lid is moved to a closed position.

To provide an attractive appearance, the cap bridge portion is provided with raised areas 62 and 64, FIGS. 3 and 4, at its opposite ends into which the lids fit to provide a flush upper surface and appearance when the lids are moved to a closed position, as shown in FIG. 8.

The upper surface of the bridge portion 32 between the longitudinally extending ribs provides a suitable land area for marking, for instance with the notations "sift" and "spoon" with appropriately directed arrows indicating to the user which lid to raise for the desired dispensing of condiments from the bottle.

We claim:

1. A molded, plastic cap, suitable for large condiment bottles, of the type adapted to be threaded onto the mouth of the bottle and to contain an inner sealing liner compressed by the cap against the bottle mouth rim, comprising a circular end having an inside surface and an exposed topside surface;

an annular skirt depending from said end having inner threads;

a reinforcing bridge portion extending across said cap end from one side to the other;

aperture means on opposite sides of said bridge portion;

lid means adapted to close said aperture means;

said end inside surface defining a flat, circular land portion contiguous with the skirt and having a width dimension effective to press seal the sealing liner against the bottle mouth rim;

said bridge portion including longitudinally extending rib means forming a longitudinally extending reduced thickness center part, said rib means being effectively flush on the inside surface with the land portion to resist distortion of the inner sealing liner and extending upwardly from said topside surface, the lid means being hinged to said longitudinally extending rib means.

2. The cap of claim 1 wherein said aperture means comprise a spoon hole on one side of said bridge means and sift holes on the opposite sides.

3. The cap of claim 2 including locking means for said lid means, the locking means for the spoon hole lid means comprising a plurality of spaced apart tabs on the underside of the lid means having an interference fit with cooperating surfaces of said upper surface.

4. The cap of claim 1 essentially free of large masses of plastic, larger or thicker in dimension than any other mass, likely to cause dimensional distortion of the cap due to cooling stresses following cap molding.

5. The cap of claim 3 wherein said longitudinally extending rib means include outstanding raised areas at opposite ends of the rib means extending along the periphery of the cap exposed topside surface adapted to embrace said lids when the latter are in a closed position, said raised areas being substantially flush with the lids when the latter are in a closed position.

6. A cap assembly suitable for large condiment bottles comprising an inner sealing liner and a molded, plastic cylindrically shaped cap, said cap being adapted to fit over the mouth of the bottle and to contain said sealing liner compressed by the cap against the rim of the bottle mouth, said cap comprising a circular end having an inside surface and an exposed topside surface;

an annular skirt depending from said end having inner threads;

a reinforcing bridge portion extending across said cap end from one side to the other;

aperture means on opposite sides of said bridge portion;

lid means adapted to close said aperture means;

said end inside surface defining a flat, circular land portion contiguous with the skirt and having a width dimension effective to press seal the sealing liner against the bottle mouth rim;

said bridge portion including longitudinally extending rib means forming a longitudinally extending reduced thickness center part, said rib means being effectively flush on the inside surface with the land portion to resist distortion of the inner sealing liner and extending upwardly from said topside surface, the lid means being hinged to said longitudinally extending rib means.

7. The assembly of claim 6 wherein the liner is glue applied to the rim of the bottle mouth.

8. The assembly of claim 6 wherein the cap is essentially free of large masses of plastic, larger or thicker in dimension than any other mass, likely to cause dimensional distortion of the cap due to cooling stresses following cap molding.

* * * * *